US007419059B2

(12) United States Patent
Christiansen et al.

(10) Patent No.: US 7,419,059 B2
(45) Date of Patent: Sep. 2, 2008

(54) DEVICE AND METHOD FOR HANDLING OF OBJECTS SUCH AS COINS OR SIMILAR ITEMS

(75) Inventors: Jörgen Christiansen, Åkarp (SE); Ricard Wanderlöf, Lund (SE)

(73) Assignee: Scan Coin Industries AB, Malmö (SE)

( * ) Notice: Subject to any disclaimer, the term of this patent is extended or adjusted under 35 U.S.C. 154(b) by 0 days.

(21) Appl. No.: 11/399,734

(22) Filed: Apr. 7, 2006

(65) Prior Publication Data

US 2006/0249435 A1 Nov. 9, 2006

Related U.S. Application Data

(63) Continuation of application No. PCT/SE2004/001434, filed on Oct. 8, 2004.

(60) Provisional application No. 60/510,874, filed on Oct. 14, 2003.

(30) Foreign Application Priority Data

Oct. 10, 2003 (SE) ..... 0302687

(51) Int. Cl.
*G07D 5/00* (2006.01)
*B07C 5/02* (2006.01)

(52) U.S. Cl. ..... 209/559; 194/302

(58) Field of Classification Search ..... 209/559, 209/552, 563, 564, 560; 453/3, 29, 30; 194/302; 198/418.7, 419.2, 572, 460.1
See application file for complete search history.

(56) References Cited

U.S. PATENT DOCUMENTS 5,141,443 A 8/1992 Rasmussen et al.

(Continued)

FOREIGN PATENT DOCUMENTS

DE 42 04 337 A1 8/1993

(Continued)

OTHER PUBLICATIONS

International Preliminary Report on Patentability for international application No. PCT/SE2004/001434—Oct. 10, 2005—pp. 1-3.

*Primary Examiner*—Patrick Mackey
*Assistant Examiner*—Mark Beauchaine
(74) *Attorney, Agent, or Firm*—Womble Carlyle Sandridge & Rice, PLLC

(57) ABSTRACT

A device for the handling of objects such as coins or similar items of different object types has a transport path with a plurality of separating stations for the objects. Each separating station is associated with an object type and is capable of assuming an activated position for separating a passing object, and a deactivated position, in which a passing object is not separated but continues past the separating station in question. The device has a sensor for detecting said object and for determining its object type, and a controller, which controls the separating stations by selective activation/deactivation depending on determined object types. The controller determines that a first train of objects has been detected, records information about an object type for said first train, determines that a second train of objects has been detected and records information about an object type for said second train. When controlling a separating station associated with the object type for said first train of objects, the controller uses the recorded information about the object type for said second train of objects.

23 Claims, 7 Drawing Sheets

U.S. PATENT DOCUMENTS 5,518,101 A * 5/1996 Simizu et al. ..... 194/317
5,531,331 A 7/1996 Barnett
5,564,974 A 10/1996 Mazur et al.
5,676,234 A * 10/1997 Smith et al. ..... 194/346
6,023,034 A * 2/2000 Nakajima et al. ..... 209/584
6,039,643 A * 3/2000 Kurosawa et al. ..... 453/3
6,431,342 B1 * 8/2002 Schwartz ..... 194/346
6,988,606 B2 * 1/2006 Geib et al. ..... 194/334

FOREIGN PATENT DOCUMENTS

GB 2 117 953 A 10/1983
WO WO 87/07742 12/1987
WO WO 99/33030 7/1999
WO WO 01/48705 7/2001
WO WO 2005/036475 4/2005

* cited by examiner

DEVICE AND METHOD FOR HANDLING OF OBJECTS SUCH AS COINS OR SIMILAR ITEMS

CROSS-REFERENCE TO RELATED APPLICATIONS

This application is a continuation of International application No. PCT/SE2004/001434, filed Oct. 8, 2004, and designating the United States, which claims priority to Swedish patent application serial number 0302687-9, filed on Oct. 10, 2003 and to U.S. provisional patent application Ser. No. 60/510,874, filed on Oct. 14, 2003. The disclosures, including Specification, claims and drawings, of Swedish patent application number 0302687-9, filed Oct. 10, 2003, and U.S. provisional patent application Ser. No. 60/510,874, filed Oct. 14, 2003, are incorporated herein in their entirety by this reference.

TECHNICAL FIELD

The present invention relates to the handling of objects such as coins or similar items of different object types. More particularly, the present invention relates to a device for the handling of such objects, comprising a transport path with a plurality of separating stations for the objects, each separating station being associated with an object type and being capable of assuming an activated position, in which a passing object is separated from the transport path, and a deactivated position, respectively, in which a passing object is not separated from the transport path but continues along the same past the separating station. The device also has a sensor for detecting the objects and determining an object type, and a controller for selective activation/deactivation of the separating stations depending on determined object types. Furthermore, the invention relates to a method for the handling of objects according to the above.

BACKGROUND ART

A coin sorting machine with active sorting is one example of a device according to the above. Active sorting means that each separating station in the machine has a movable member which by receiving control signals can be caused to switch between two different positions; a first, deactivated position in which the movable member assumes a retracted position with respect to the transport path and thus does not affect a passing coin, and a second, activated position in which the movable member assumes a position which intrudes upon the transport path and thus will separate a passing coin from the transport path. Electromagnetic solenoids are often used in the separating stations, wherein the control signals are applied voltages or currents at appropriate levels and the movable member is the movable core of the solenoid, and/or a deflector coupled to this movable core. Which separating station that is to be activated so as to sort off an individual coin is determined by a coin sensor and a controller, which detect suitable physical parameters for the coin (such as conductivity, permeability, diameter and/or thickness), determine a coin type (such as denomination, valid/false) and supply control signals to the correct separating station at the appropriate moment, i.e. at a correct timing so that the particular individual coin will be separated when the movable member of the separating station assumes its activated position, without thereby separating other coins than the intended one (for instance such coins that have another denomination and therefore shall be separated by another separating station).

One example of a coin sorting machine according to the above is disclosed in WO 99/33030, which in its illustrated embodiment has 10 separating stations, each having a solenoid, distributed along a circular transport path. Another example of a coin sorting machine for active sorting, having a linear rather than a circular transport path, is disclosed in WO 87/07742.

Another type of coin sorting machines are such that operate with a passive sorting technique. Here, instead of separating stations that can be activated/deactivated, purely passive arrangements are used for separating the coins at respective positions along the transport path. In a common type of passive coin sorting machines the coins are caused to roll down a sloping sorting rail, where sorting knives are arranged at successively decreasing heights above the transport path, wherein coins with the largest diameter are separated by the first sorting knife in the transport direction, and then coins having the second largest diameter are separated by the next sorting knife, and so on. Another common type of passive coin sorting machine instead uses a rotary carrier device which transports the coins in a circular transport path by way of a dragging movement over a baseplate, in which coin falling openings of successively increasing size have been arranged.

There are several drawbacks with the passive coin sorting machines described above. For instance, mechanical measures are required in the machine (replacement of baseplate, height position adjustment of sorting knives, etc) so as to adapt the machine for use in a coin system with another currency, etc. Another drawback is mechanical wear and tear of coins as well as sorting mechanism. In addition, some passive coin sorting machines have a limited sorting capacity.

Coin sorting machines with active sorting technique make it possible to avoid or at least mitigate the problems given above and are therefore both interesting and popular. Furthermore, they can be made compact.

By choosing components for the sorting mechanism and the coin sensor with high quality and accuracy, and by carefully programming the controller of the coin sorting machine, a coin sorting machine with active sorting technique can be made to exhibit an astonishingly high sorting capacity and a very good accuracy (low error rate). Of course, the active sorting technique has certain technical limitations as regards how fast the separating stations can switch between activated and deactivated positions. Therefore, during the operation of a coin sorting machine with active sorting technique, situations with so called coin trains are repeatedly occurring. A coin train is a sequence of successive coins, which even if they can be detected and determined in type individually by the coin sensor and the controller, they are too close to each other in distance to be sorted off individually by the separating stations. Such situations with coin trains can be handled appropriately by programming the controller to handle a coin train in different ways depending on its nature: whether all coins contained in the coin train are destined to the same destination or to different destinations, whether the coin train contains invalid coins that are to be returned (known as reject coins, etc), and so on.

Since coin sorting machines with active sorting technique contain movable components in the separating stations, there is a common need to increase the efficiency of the machine (the sorting capacity), at the same time reducing the wear and tear of the movable components, reducing the heat generated from their operation as well as limiting the generated noise to a reasonable level. By handling certain coins as a coin train rather then individual coins, improvements may be achieved in these areas.

SUMMARY OF THE INVENTION

An objective of the present invention is to provide improved devices and methods for the handling of objects such as coins or similar items with separating stations that can be activated/deactivated, focusing on the above-mentioned problems with sorting capacity, wear and tear of movable parts, heat generation and noise.

The objective stated above has been achieved through the inventor's realisation that not only a single train of objects should be considered when handling the objects (for instance sorting of coins) but also situations with successive trains of objects.

More specifically, the inventors have realised that the objects can be handled in the following way according to a first aspect of the invention: determining that a first train of objects has been detected by the sensor; recording information about an object type for said first train of objects; determining that a second train of objects has been detected by the sensor; recording information about an object type for said second train of objects; and using the recorded information about the object type for said second train of objects when controlling a separating station associated with the object type for said first train of objects.

Furthermore, the inventors have realised that the objects can be handled in the following way according to a second aspect of the invention: determining that a first train of objects has been detected; determining that a second train of objects has been detected, wherein the distance between the end of the first train (the trailing edge of its last object) and the beginning of the second train (the leading edge of its first object) per se is such that trains of objects could be handled independently from each other by the separating stations and the controller; determining whether the objects of the first train have the same destination among the separating stations as the objects of the second train and, if so, selectively activating the destination separating station in question and maintaining its activation during separation of the objects of the first train as well as the objects of the second train without intermediate deactivation of the destination separating station.

The objectives stated above are achieved by a device and at method, respectively, according to the appended independent patent claims. A device according to the invention can be comprised in a coin sorting machine. Then, the object types may include a number of different coin denominations, and the case where a coin is invalid. In addition to coins the objects may be constituted by tokens, gaming markers etc.

A device according to the invention may comprise means for transporting the objects along the transport path, the transport path being circular or linear.

The controller in a device according to the invention may be adapted to form a train of objects logically by successively combining objects that have been detected one after the other, these objects having a mutual distance less than a threshold value. This threshold value may be a function of a shortest possible time for activation followed by deactivation of said separating stations.

The controller in a device according to the invention may be adapted to perform selective activation of said same destination station and maintain its activation so as to separate the objects in said first and second trains without intermediate deactivation, even if the distance between a last object of said first train of objects and a first object of said second train of objects exceeds said threshold value.

Other objectives, advantages, aspects and features of the invention will appear from the attached detailed disclosure, the patent claims and the accompanying drawings.

BRIEF DESCRIPTION OF THE DRAWINGS

The invention will now be described in more detail with reference to the accompanying drawings, in which.

DETAILED DISCLOSURE OF THE INVENTION

Figure 1:
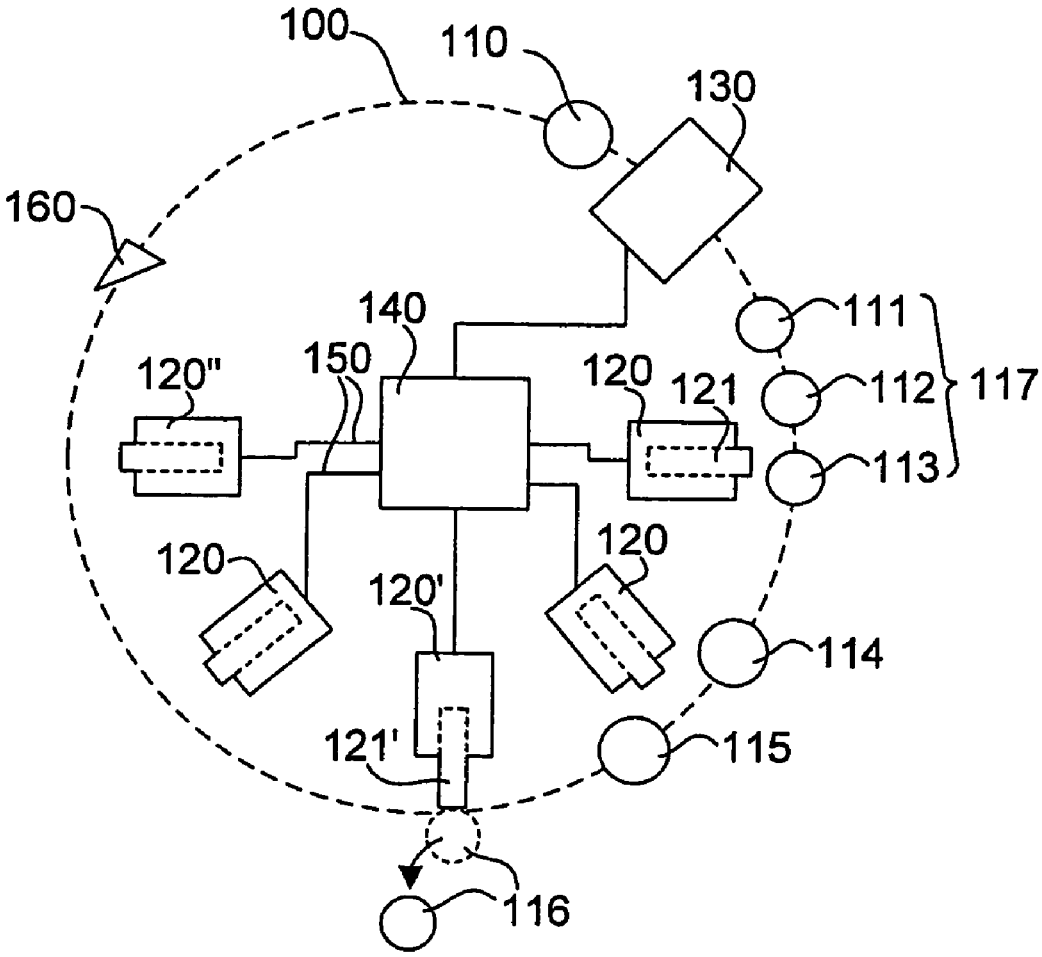
FIG. 1 schematically illustrates a device for the handling of objects such as coins or similar items, comprising a transport path with circularly arranged separating stations that may be activated/deactivated.

In FIG. 1 there is shown a device according to one embodiment of the invention for sorting coins 110-116 which are carried along a circular transport path 100 by a transport mechanism not shown in FIG. 1. The transport mechanism as well as the general device may preferably be of the kind which is disclosed in the previously mentioned WO 99/33030, which is incorporated herein by reference in its entirety. The transport direction for coins 110-116 along the transport path 100 is clockwise in FIG. 1.

The device has a number of separating stations 120 which are located along the circular transport path 100 and each of which is associated with a certain coin type. The term coin type may include different coin denominations but also whether a coin is invalid and should be returned, or has a type which could not be determined and therefore should be re-circulated, or should be re-circulated for other reasons, according to the further description below. In FIG. 1 there are illustrated two different coin types, the coins 110, 111, 112, 113 and 116 belonging to a first coin type and having a smaller size than coins 114 and 115 which belong to a second coin type. In reality the device in FIG. 1 will however handle more coin types than two in most applications.

A coin sensor 130 is located next to the transport path 100 and serves to detect an individual coin when it passes the sensor 130 along the transport path 100 as well as to determine a coin type for the coin in cooperation with a controller 140. To this end, various physical parameters are detected for the coin, such as conductivity, permeability, diameter, thickness or weight, and the detection result is compared to prestored reference data, wherein a decision is made that the coin belongs to a certain coin type, if there is sufficient correspondence with any of the coin types that are defined by aforesaid reference data.

The controller 140 may be implemented by a commercially available microprocessor such as a CPU (Central Processing Unit), by a DSP (Digital Signal Processor) or by another programmable logic device such as an FPGA (Field Programmable Gate Array), or alternatively as an ASIC (Application-Specific Integrated Circuit), as discrete analogue and/or digital components, or as any combination of the above. The controller 140 has access to internal and/or external memory such as RAM, ROM, EEPROM, flash memory, or any combination of the above.

Based on the coin type which has been determined by the coin sensor 130, the controller 140 will control the different separating stations 120 by supplying control signals 150, so that each station at the correct time, i.e. when the coin in question to be sorted off is positioned next to the separating station that the coin type of the coin in question is associated with, is activated so as to separate the coin. To this end, the controller 140 uses an encoder or similar not shown in FIG. 1 so as to keep continuously updated with the rotational angle and velocity of the transport mechanism that carries the coins along the transport path 100.

The separating stations 120, which preferably are electromagnetic solenoids, have a movable member 121 which may be switched between a deactivated, retracted position 121 and an activated extended position 121'. In the deactivated position 121 all coins 110-116 pass past the separating stations 120 along the transport path 100 without being separated, whereas a coin 116 which is positioned next to an activated separating station 120' will be separated from the transport path 100 by the movable member 121' in the separating station 120', as illustrated in FIG. 1. The separating stations may also be driven hydraulically, pneumatically or purely mechanically, or by any combination of the above.

The device comprises a re-circulation means 160, the purpose of which is to return such coins, that for some reason have not been separated by any of the separating stations 120, back to the transport path 100, so that the 20 coin in question will get a new chance of successful separation. Coins may have to be resorted for several reasons. One example is when two consecutive coins happen to overlap each other or otherwise lie too close to each other when they are detected by the coin sensor 130, 25 wherein the coin sensor can not determine any coin type for the coins. When such coins are resorted, it is likely that they will keep a larger distance the next time they pass the coin sensor 130. Therefore, the re-circulation is preferably such that re-circulation coins will not 30 immediately continue along the transport path 100 out on a new lap past the coin sensor 130 and the separating stations 120 but will instead be returned to the mass of coins which yet has not been processed by the device. Another reason for re-circulation can be that several 35 consecutive coins 111, 112, 113 in fact have been detected and determined in type by the coin sensor 130 and have been found to be of different coin types but have too short mutual distance to be separated individually by the separating stations 120. Such a sequence of coins 111-113, referred to as a coin train, is labeled 117 in FIG. 1. The processing of coin trains according to the invention will be described in detail later with reference to FIG. 3*a*-3*d* and FIG. 4-8.

Any of the separating stations 120 may operate as return station (reject) to return invalid coins back to the user. In FIG. 1 the separating station 120" has this task. Furthermore, any of the separating stations 120 may have as its task to operate as re-circulation means 160, i.e. to return coins through its separating movement back to the not yet processed mass of coins for another transport along the transport path 100. In the embodiment disclosed in FIG. 1, however, the re-circulation means 160 is a separate, passive means which deflects re-circulation coins. In a re-circulation situation according to FIG. 1 all separating stations 120 are therefore kept deactivated, wherein coins that are to be re-circulated will travel past all separating stations 120 and be returned for re-circulation by means 160. The nature of the re-circulation means 160 is no central part of the present invention, but one possible re-circulation arrangement is shown in WO 01/48705. It is also possible to solve the re-circulation manually by aggregating coins that need to be re-circulated at a certain place in the coin sorting machine to be manually moved to another location for a new sorting round.

Figure 2:
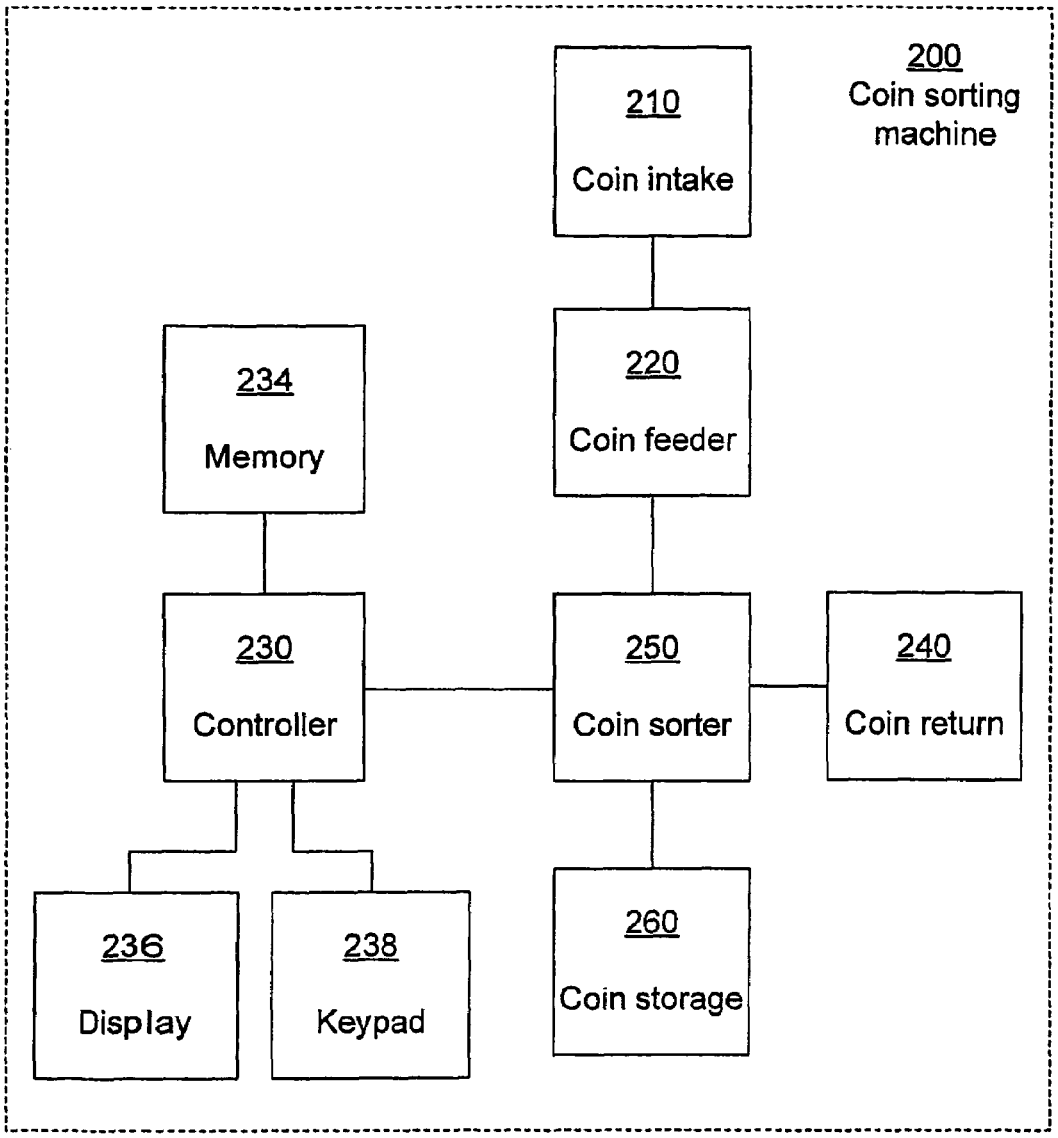
FIG. 2 illustrates a schematic block diagram of a coin sorting machine, containing a device according to FIG. 1, FIG. 3*a*-3*d* illustrate four common situations with coin trains that are handled by the device and method according to the invention.

FIG. 2 discloses a block diagram of the most important parts of a coin sorting machine 200, in which the device according to FIG. 1 may be included. Rather than being a coin sorting machine the machine 200 could just as well have been a coin counting apparatus, a machine for coin quality testing, a machine for identification of false or foreign coins, or a machine for sorting/counting/other handling of tokens, gaming markers, etc.

A mass of coins to be sorted by the machine 200 is deposited in a coin intake 210. The coins are carried through a coin feeder 220, such as a transport belt or a coin feeding device of "hopper" type, to a coin sorter 250, which is constituted by the device of FIG. 1, or comprises the same. The coin sorter 250 is operatively connected to a controller 230, which in turn is operatively connected to a memory 234 such as a RAM, ROM, EEPROM, flash memory, hard disc, or any combination thereof.

At least parts of the memory 234 may be implemented by internal memory in the controller. The controller 230 may be implemented by a commercially available microprocessor such as a CPU (Central Processing Unit), by a DSP (Digital Signal Processor), or by another programmable logic device such as an FPGA (Field Programmable Gate Array), or alternatively as an ASIC (Application-Specific Integrated Circuit), as discrete analogue and/or digital components, or as any combination of the above.

The controller 230 is responsible for the overall operation of the machine 200, including controlling a display 236 and a key pad 238 which forms a user interface. In embodiments of the invention the controller 230 may in addition cooperate with the coin sensor 130 and the controller 140 in the device according to FIG. 1, or may alternatively implement the controller 140, so as to handle detection of coins, determination of their coin types, if necessary logically grouping them into coin trains and in response controlling the separating stations 120 by way of control signals 150.

The coin sorting machine 200 also comprises a coin return 240 which returns non-approved coins through an external opening in the machine 200, so that such coins may be collected by the user. Coins that have been successfully sorted by the coin sorter 250, on the other hand, are collected in specific coin containers belonging to a coin storage 260. The coin containers in the coin storage 260 may be externally accessible to the user, or may alternatively for reasons of security be accommodated in an internal locked space in the coin sorting machine 200.

The operation of the device according to the embodiment in FIG. 1 will now be described in detail with reference to the remaining Figures. Thus, the controller 140 is programmed to control the operation of the separating stations 120 in response to coin detection information from the coin sensor 130 in the following way.

Figure 4:
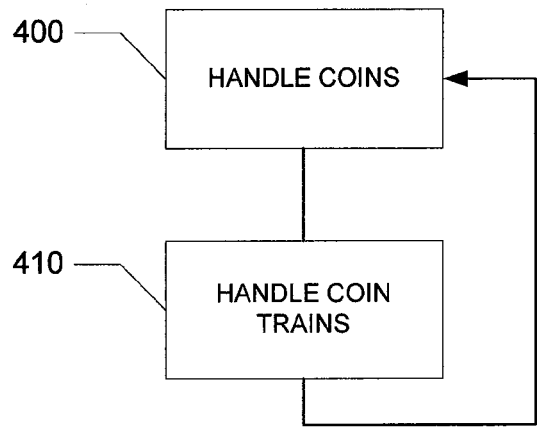
FIG. 4-8 illustrate the operating method of a preferred embodiment of the invention.
Figure 5:
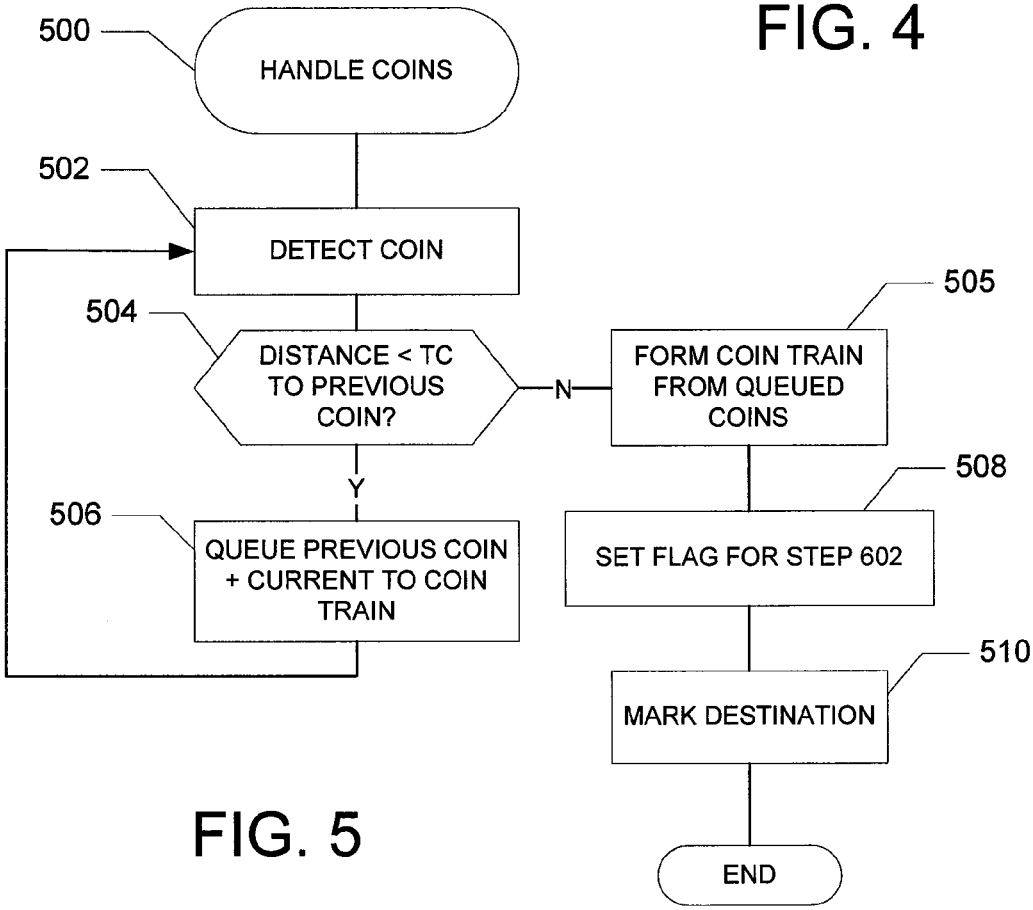
Figure 6:
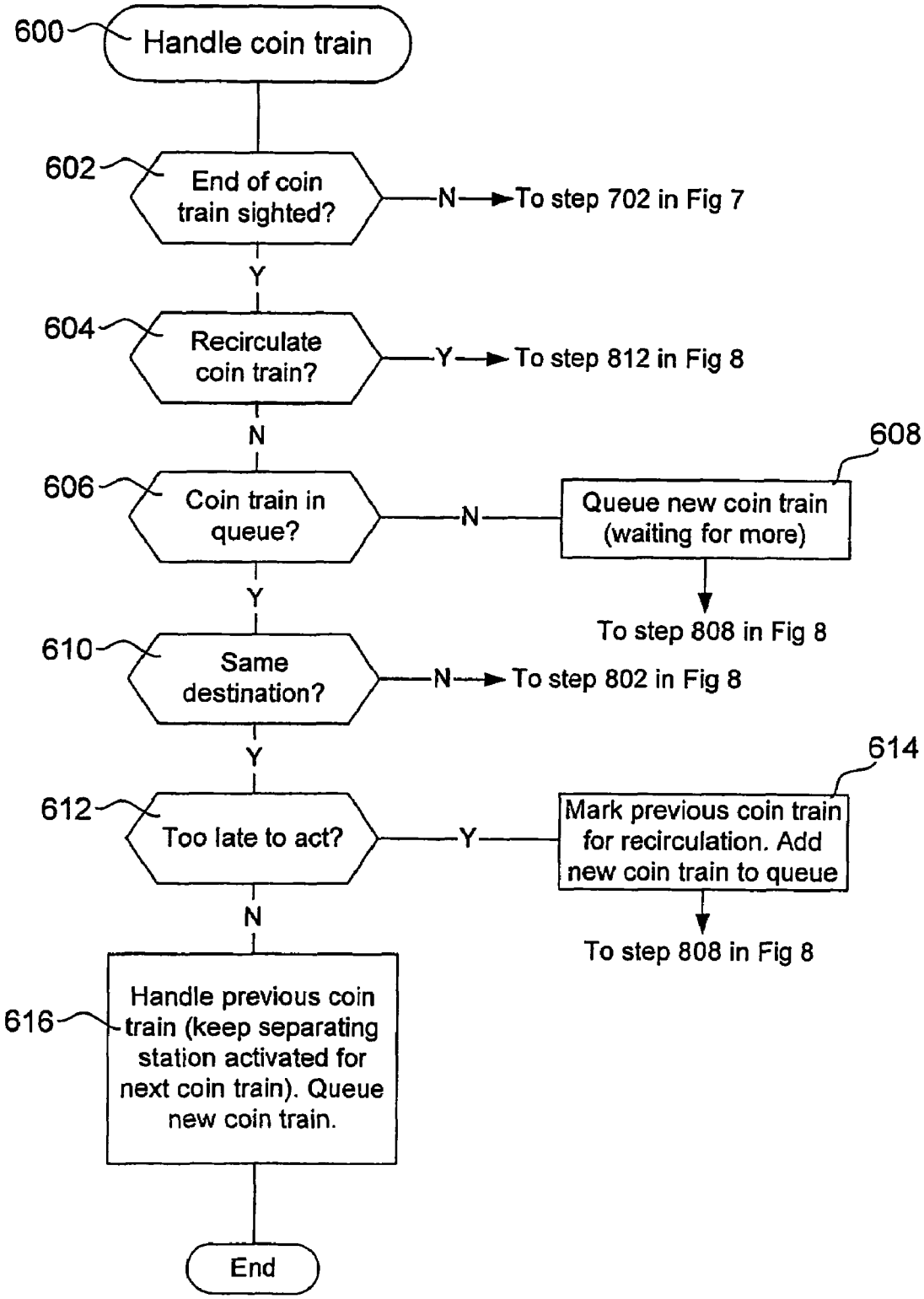
Figure 7:
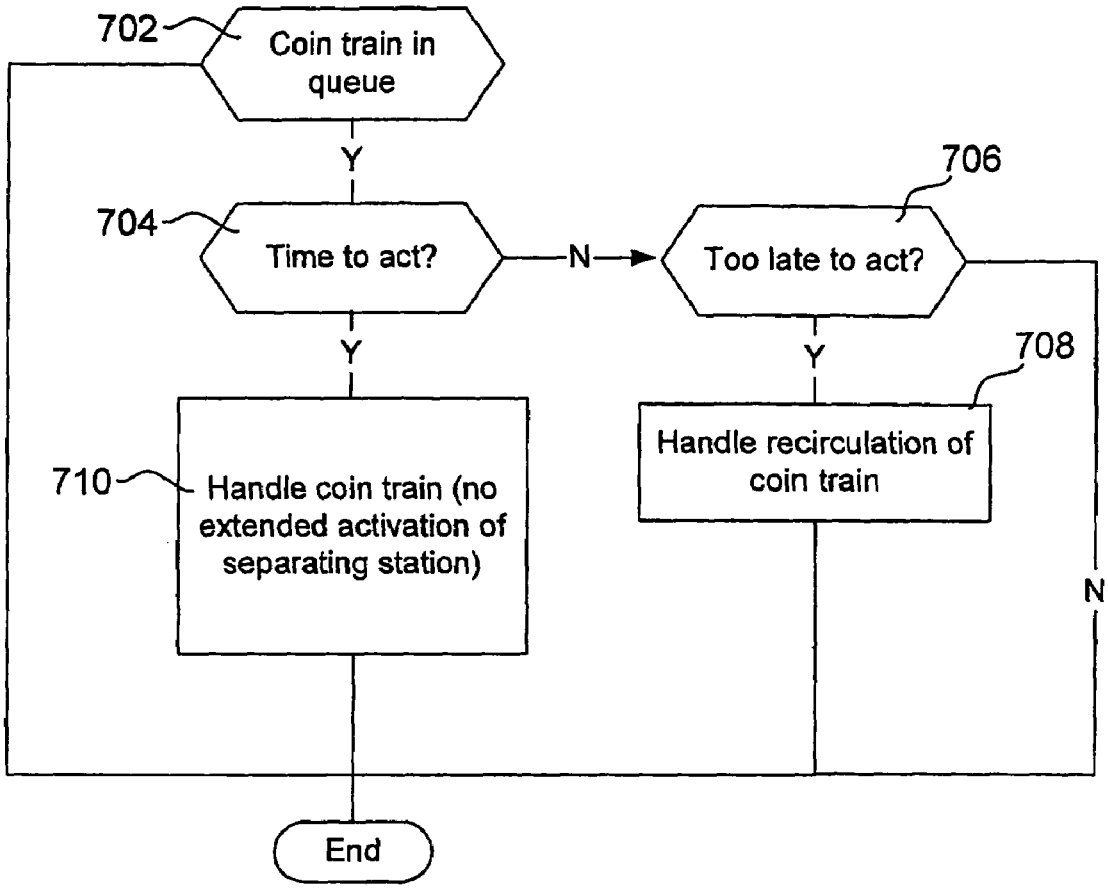
Figure 8:
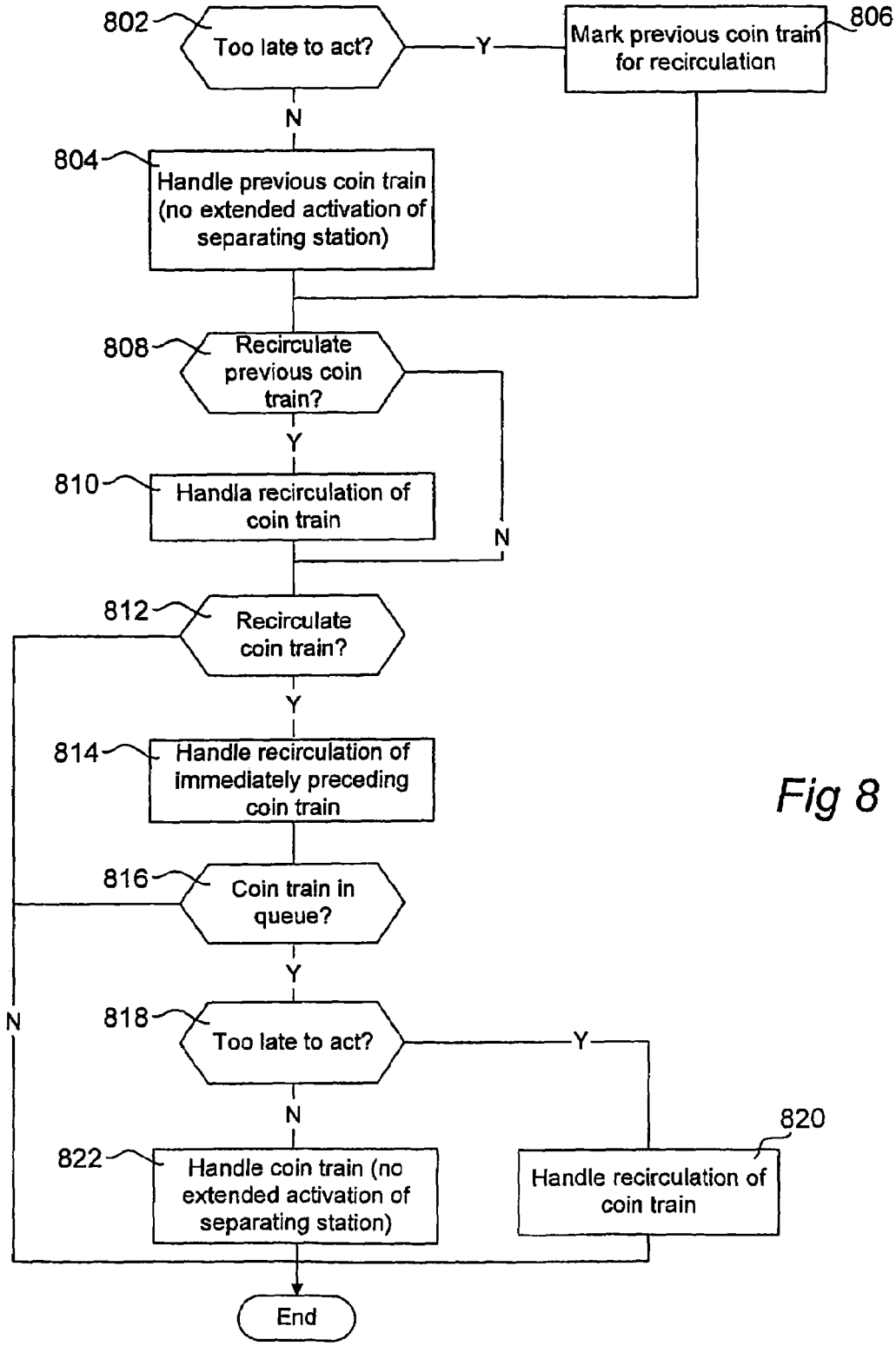

The overall operation is as illustrated in FIG. 4. A routine 400 handles individual coins and when applicable groups then logically into coin trains. The routine 400 is illustrated in more detail in FIG. 5. Then, formed coin trains are handled in a routine 410, which will be described in more detail with reference to FIG. 6-8.

The routine for the handling of individual coins starts by the coin sensor 130 detecting the coin in question in step 502. A type for the detected coin is determined in accordance with the description above, and the coin type may hence be any of a number of different denominations that the device is adapted to handle, but also the case where the detected coin has been identified as invalid, or the case where no type could be determined for the detected coin. It is checked in step 504 whether the detected coin is too close in distance to an immediately preceding coin, i.e., at a distance less than a threshold value tc (too close), for the detected coin and the preceding coin to be separated individually by the separating stations 120. The interpretation of the distance threshold value tc appears from FIG. 3*a*-3*d*. If the distance to the preceding coin is less than the threshold value tc, the preceding coin is queued together with the currently detected coin for later forming of a logical coin train in step 506, and then the execution returns to step 502 for detecting a new coin. If the distance to the preceding coin, on the other hand, is not less then the threshold value tc in step 504, a coin train is formed in step 508 consisting of the detected coin and, if applicable, coins that are to belong to this coin train and that have been queued in previous iterations of step 506. If the detected coin is a "real" individual coin, in the sense that it has a distance <tc to the immediately preceding coin as well as to the immediately succeeding coin, such a coin will consequently form a coin train in step 505 consisting of it self only. If, on the other hand, the detected coin is preceded by queued coins from step 506, the coin in question will be logically grouped together in step 505 with the queued coins and be placed at the end of the formed coin train. In step 508 a flag is set with the meaning that the end of a coin train has been sighted. This flag will be used in step 602 in FIG. 6. The destination of the coin train now formed among the coin separating stations 120, return station 120" or re-circulation means 160 is also recorded in step 510. If all coins in the train are of the same type, the destination is the separating station associated with the type in question. If, however, not all coins in the train are of the same type, the destination will be the re-circulation means 160.

When the routine 400/500 for handling individual coins has been ended, it is followed, as mentioned, by the routine 410 for the handling of coin trains. This routine is labelled 600 in FIG. 6 and starts with aforesaid step 602, in which it is checked whether a new coin train has been formed in step 508. If this is not the case, the execution continues according to the illustration in FIG. 7 with a check in step 702 as to whether there is a previous coin train in queue. If this is not the case, there is currently no action to take, wherein the execution ends. If, however, there is a previous coin train in queue, the execution continues to step 704. This situation is illustrated in FIG. 3*d*, where there is a previous coin train 1 having a certain destination x. It is checked in step 704 whether the distance from the leading edge of the first coin 300 of the coin train to the intended destination x (the shortest distance for sorting to be possible is labelled 302 in FIG. 3*d*) is so short that the coin train must be handled immediately in order to be sorted off at the destination x. If it is found in step 704 that the distance from the first coin 300 to the destination x exceeds the smallest distance 302, it is possible to wait yet another iteration for the end of a new coin train to be detected. Therefore, according to the invention the controller chooses not to handle the existing coin train 1 in FIG. 3*d* at the current moment but instead waits by letting the execution continue to step 706. Step 706 is a pure safety check, where it is checked whether there (after all) in fact is a too short distance between the coin train 1 and the destination x. In such a case, the coin train 1 in FIG. 3*d* will be re-circulated in step 708, if not the execution of this iteration of routine 600 is ended. If it was found in step 704 that the coin train 1 must be handled during the current iteration, i.e. that the decision slot 304, which is constituted by the difference between the actual distance from the first coin 300 in the coin train 1 to the destination x and the smallest distance 302, is so small that there is a risk that there will be no time to separate the coin train 1 at the destination x, if one waits until the next iteration, the coin train 1 is handled in step 710 by having the controller 140 supplying, at the correct moment, suitable control signals 150 to the separating station 120 which corresponds to destination x, wherein this separating station is activated and the movable member 121' assumes it extended position according to FIG. 1. The separating station that corresponds to destination x is kept activated, until all coins contained in the coin train 1 have been separated, wherein the controller 140 will deactivate the separating station in question and its movable member will return to its retracted position 121.

Referring again to FIG. 6, if it was found in step 602 that a coin train has been detected, it is checked in step 604 whether this new coin train shall be re-circulated. Such a situation is illustrated in FIG. 3*c*, where a first coin train 1 having a certain destination x is followed by a second coin train 2 having another destination z, which in this case is the re-circulation means 160 in FIG. 1. The reason why the coin train 2 must be re-circulated may be that any coin 310' in the coin train has been detected as unidentifiable, or alternatively has another denomination than any other coin 310 in the coin train. At the same time a flag is set to be used in a step 812 in FIG. 8, wherein the control continues to this step. Since the flag is set in this case, the execution continues to step 814 in FIG. 8, wherein the controller 140 from now on will control the separating stations 120, so that the coin train 2 of FIG. 3*c* during its transport along the transport path 100 will pass all separating stations and reach the recirculation means 160. Then, it is checked in step 816 whether there is a previous coin train in queue. If this is not the case, the execution of this iteration is ended. If, on the other hand, there is a previous coin train in queue, labelled coin train 1 in FIG. 3*c*, it is checked in step 818 whether there is still time to act for separation (cf. the description above for steps 704-708 in FIG. 7). If it is too late to act with of-sorting off the coin train 1 at the intended destination x, this coin train 1 is treated as re-circulation train in step 820. Otherwise this coin train 1 is handled in the usual manner by activation followed by deactivation of the correct separating station 120 which corresponds to the destination x (cf. the description above of step 710 in FIG. 7).

Referring again to FIG. 6, if it was found in step 604 that the new coin train is not to be re-circulated, it is checked in step 606 whether there is a previous train in queue. If this is not the case, the new coin train is placed in queue in step 608, waiting for potential future coin trains. Then, the execution continues to step 808 in FIG. 8, wherein essentially the same functionality is performed as has been described above for steps 812 and 814. If it was found in step 606 that there is a previous coin train in queue, it is checked in step 610 whether this new coin train has the same destination as the previous one. If this is not the case, the situation is as illustrated in FIG. 3*b*, i.e. a first coin train 1 has a destination x, whereas a second coin train 2 has a destination y, which is not the same as x. The execution then continues in step 802 in FIG. 8, wherein it is checked whether the previous coin train 1 still has at least the smallest distance 302 between the first coin 300 and the intended destination x. If it turns out in step 802 that it is too late to act upon the previous coin train 1, this previous coin train is marked as re-circulation train in step 806. If, on the other hand, there is still time to act upon this previous coin train, this is marked for handling in step 804 in the usual manner (cf. the description above for step 710 in FIG. 7). Than the execution continues in step 808 in the way described above.

Figure 3A:
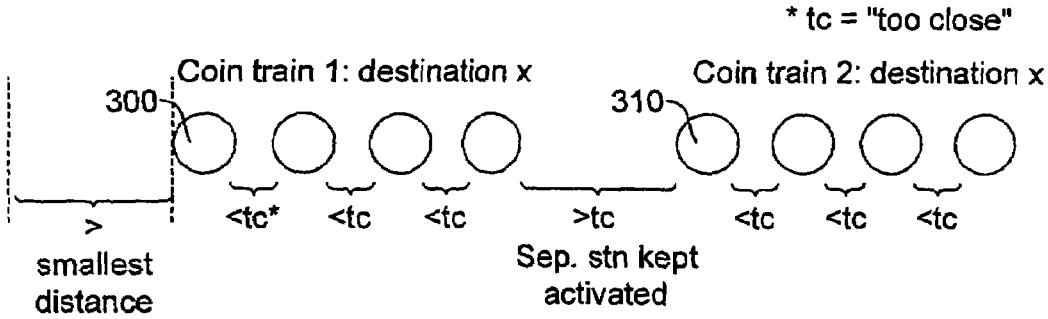
Figure 3B:
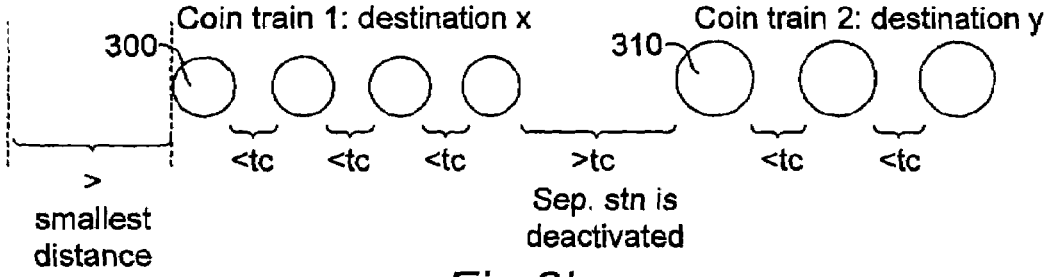
Figure 3C:
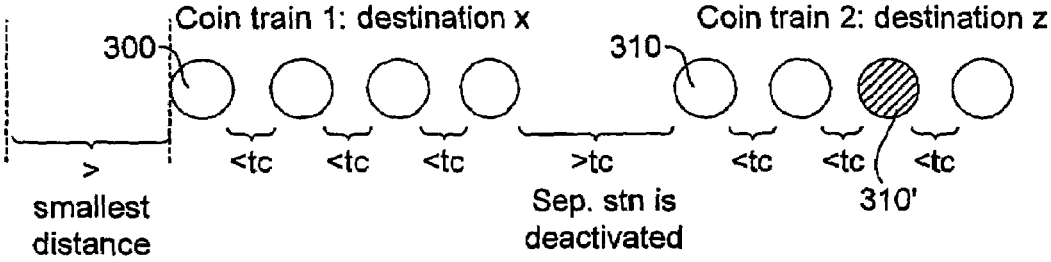
Figure 3D:
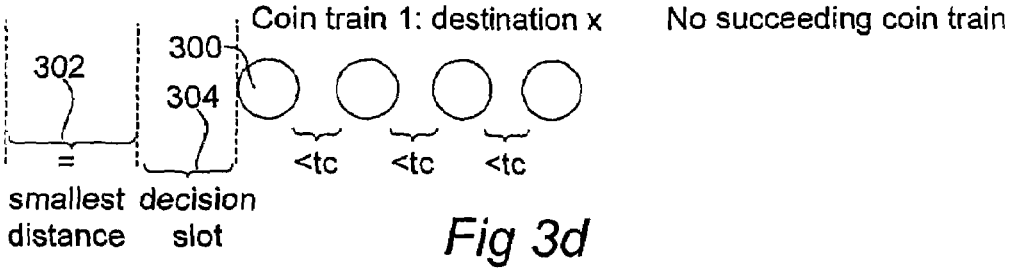

If it was found in step 610 that the preceding coin train has the same destination as the new coin train, this corresponds to a situation which is illustrated in FIG. 3*a*. Than, it is checked in step 612 whether it is too late to act upon the previous coin train 1. If this is the case, the previous coin train is marked as re-circulation train in step 614, and the new coin train 2 is placed in queue, wherein the execution continues with step 808 in FIG. 8 in the way described above. On the other hand, if it was found in step 612 that there is still time to act upon the previous coin train 1, this coin train 1 is handled by the controller 140 controlling, at the correct moment, the correct destination x among the separating stations 120 to assume its activated position, wherein all coins comprised in the coin train 1 are separated. Furthermore, the controller 140 controls the separating station 120 in question to keep its activated position even after the last one of the coins in the coin train 1 has been separated. Hereby, there is an opportunity to sort off also the next coin train 2 without deactivating and then again activating the separating station 120 in question in between. Since the situation in FIG. 3*a* is common, the procedure according to step 616 means a considerable reduction in the number of activations followed by deactivations of the separating stations 120, with associated advantages in terms of reduced mechanical wear and tear, reduced heat generation, lower noise and, therefore, an opportunity of a higher sorting speed. Thus, the next coin train 2 is queued in step 616 to be sorted at the same destination x as the coin train 1 at a coming correct moment. Thus, this next coin train 2 logically becomes the previous coin train 1 in later iterations of the routine in FIG. 6, wherein the routine will wait for yet another coin train to be detected, which again may be of the same type and have the same destination x as before, wherein there is an opportunity to further keep the separating station in question in its activated position without intermediate deactivation between the coin trains. In more favourable situations, thanks to the invention it can thus be possible to sort off several and even many successive coin trains containing coins of the same type and thus intended for the same destination x. will only a first initial activation of the separating station (when the first coin train is separated) and a final deactivation of the separating station (when the last coin train has been sorted off). The penalty paid is that one must sometimes wait so long a time for a new coin train that the decision slot 304 for being able to sort off the previous coin train 1 has lapsed, wherein this previous coin train 1 then must be re-circulated. Tests and simulations however demonstrate that the advantages prevail and that the activations/deactivations of the separating stations are reduced as whole for a typical mass of coins.

The invention has been described above in the form of exemplifying embodiments. However, the invention is in no way limited to these but includes many other alternatives, as is defined by the scope of the appended patent claims and is further readily realised by a man skilled in the art.

What is claimed is:

1. A device for handling objects such as coins or similar items of different object types, comprising a transport path having a plurality of separating stations for said objects, wherein each separating station is for separating objects of one object type from the transport path and each separating station is operable between an activated state, in which a passing object is separated from the transport path, and a deactivated state, in which a passing object is not separated from the transport path but continues along the transport path past the separating station in question, a sensor for detecting said objects and respectively determining an object type of each of said objects, and a controller associated with said plurality of separating stations for respectively controlling said separating stations by selectively activating, deactivating, or maintaining an activated state of each separating station depending on the determined object type of each of said objects, said controller being configured for:

logically forming a plurality of trains of objects, each train of objects having an object type, by successively combining objects which have been detected one after the other and which objects have a distance therebetween which is less than a threshold value;

determining that a first train of objects has been detected by the sensor;

determining an object type of said first train of objects;

activating to an activated state a first separating station based on the determined object type of said first train of objects;

determining that a second train of objects has been detected by the sensor;

determining an object type of said second train of objects; and while said first separating station is in the activated state, selectively deactivating or maintaining the activated state of said first separating station based on the determined object type of said second train of objects.

2. A device according to claim 1, further comprising a transport mechanism for transporting the objects among the transport path, the transport path being circular.

3. A device according to claim 1, further comprising a transport mechanism for transporting the objects along the transport path, the transport path being linear.

4. A device according to claim 1, wherein said object types include a number of different coin denominations.

5. A device according to claim 4, wherein said object types further include the case that a coin is invalid.

6. A device according to claim 1, wherein said threshold value is a function of a shortest possible time for activation followed by deactivation of said separating stations.

7. A device according to claim 1, wherein said controller is operable to:

determine a destination station among said separating stations for the objects of said first train;

determine a destination station among said separating stations for the objects of said second train;

determine that said destination station for the objects of said first train is a same separating station as said destination station for the objects of said second train; and selectively activate to an activated state said same separating station and maintain the activated state for separating the objects of said first and second trains without intermediate deactivation, despite the fact that the distance between a last object of said first train of objects and a first object of said second train of objects exceeds said threshold value.

8. A coin sorting machine, comprising a device according to claim 1.

9. A device of claim 1 wherein the separating stations each have a moveable member which is respectively positionable between a retracted position corresponding with the deactivated state of a respective separating station and an extended position corresponding with the activated state of a respective separating station.

10. A device according to claim 1, wherein the plurality of trains of objects comprises a train of coins of a same denomination that are grouped together.

11. A device for handling objects such as coins or similar items of different object types, comprising a transport path having a plurality of separating stations for said objects, each separating station being for separating objects of one object type from the transport path and each separating station being operable between an activated state, in which a passing object is separated from the transport path, and a deactivated state, in which a passing object is not separated from the transport path but continues along the transport path past the separating station in question, a sensor for detecting said objects and respectively determining an object type of each of said objects, and a controller associated with said plurality of separating stations for respectively controlling said separating stations by selectively activating, deactivating, or maintaining an activated state of each separating station depending on the determined object type of each of said objects, said controller being configured for:

logically forming a plurality of trains of objects, each train of objects having an object type, by successively combining objects which have been detected one after the other and which objects have a distance therebetween which is less than a threshold value;

determining that a first train of objects has been detected by the sensor;

determining a destination station among said separating stations for the objects of said first train;

determining that a second train of objects has been detected by the sensor;

determining a destination station among said separating stations for the objects of said second train;

determining that said destination station for the objects of said first train is a same separating station as said destination station for the objects of said second train, and selectively activating to an activated state said same separating station and maintaining the activated state for separating the objects of said first train of objects as well as the objects of said second train of objects without intermediate deactivation.

12. A device according to claim 11, further comprising a transport mechanism for transporting the objects among the transport path, the transport path being circular.

13. A device according to claim 11, further comprising a transport mechanism for transporting the objects along the transport path, the transport path being linear.

14. A device according to claim 11, wherein said object types include a number of different coin denominations.

15. A device according to claim 14, wherein said object types further include the case that a coin is invalid.

16. A device according to claim 11, wherein said threshold value is a function of a shortest possible time for activation followed by deactivation of said separating stations.

17. A device according to claim 11, the controller being for performing said selective activation of said same separating station and maintain the activated state thereof for separating the objects of said first and second trains without intermediate deactivation, despite the fact that the distance between a last object of said first train of objects and a first object of said second train of objects exceeds said threshold value.

18. A coin sorting machine, comprising a device according to claim 11.

19. A method for handling objects such as coins or similar items of different object types, wherein the objects are carried along a transport path having a plurality of separating stations, each separating station being for separating objects of one object type from the transport path and each separating station being operable between an activated state, in which a passing object is separated from the transport path, and a deactivated state, in which a passing object is not separated from the transport path but continues along the transport path past the separating station in question;

the objects are detected;

the object type of each detected object is respectively determined; and the separating stations are selectively activated, deactivated, or maintained in an activated state depending on the determined object type of each of the objects, the method further comprising:

logically forming a plurality of trains of objects, each train of objects having an object type, by successively combining objects which have been detected one after the other and which objects have a distance therebetween which is less than a threshold value;

determining that a first train of objects has been detected by the sensor;

determining an object type of the first train of objects;

activating to an activated state a first separating station for separating objects of the object type of the first train of objects based on the determined object type of the first train of objects;

determining that a second train of objects has been detected by the sensor;

determining an object type of the second train of objects; and while the first separating station is in the activated state, selectively deactivating or maintaining the activated state of the first separating station based on the determined object type of the second train of objects.

20. A method according to claim 19, further comprising:

determining a destination station among the separating stations for the objects of the first train;

determining a destination station among the separating stations for the objects of the second train;

determining whether the objects of the first train and the objects of the second train have a same separating station; and selectively activating to an activated state the same separating station and maintaining the activated state thereof for separating the objects of the first and second trains without intermediate deactivation, despite the fact that the distance between a last object of the first train of objects and a first object of the second train of objects exceeds the threshold value.

21. A method of claim 19, wherein the logically forming a plurality of trains of objects comprises grouping together coins of a same denomination.

22. A method for handling objects such as coins or similar items of different object types, wherein the objects are carried along a transport path having a plurality of separating stations, each separating station being for separating objects of one object type from the transport path and each separating station being operable between an activated state, in which a passing object is separated from the transport path, and a deactivated state, in which a passing object is not separated from the transport path but continues along the transport path past the separating station in question;

the objects are detected;

the object type of each detected object is respectively determined; and the separating stations are selectively activated, deactivated, or maintained in an activated state depending on the determined object type of each of the objects, the method further comprising:

logically forming a plurality of trains of objects, each train of objects having an object type, by successively combining objects which have been detected one after the other and which objects have a distance therebetween which is less than a threshold value;

determining that a first train of objects has been detected by the sensor;

determining a destination station among the separating stations for the objects of the first train;

determining that a second train of objects has been detected by the sensor;

determining a destination station among the separating stations for the objects of the second train;

determining that the destination station for the objects of the first train is a same separating station as the destination station for the objects of the second train, and selectively activating to an activated state the same separating station and maintaining the activated state for separating the objects of the first train of objects as well as the objects of the second train of objects without intermediate deactivation.

23. A method according to claim 22, wherein the selective activation of the same separating station is performed and the activated state thereof is maintained for separating the objects of the first and second trains without intermediate deactivation, despite the fact that the distance between a last object of the first train of objects and a first object of the second train of objects exceeds the threshold value.

* * * * *